US007640881B1

(12) United States Patent
Gerst et al.

(10) Patent No.: US 7,640,881 B1
(45) Date of Patent: Jan. 5, 2010

(54) DOCK SYSTEM

(76) Inventors: Paul R. Gerst, 748 Harbor Island Dr., Newport Beach, CA (US) 92660; Paul Vernon Gerst, 28621 La Saragosa, Laguna Niguel, CA (US) 92677; John William Gerst, 1149 Crystal Downs Dr., Chula Vista, CA (US) 91915

( * ) Notice: Subject to any disclaimer, the term of this patent is extended or adjusted under 35 U.S.C. 154(b) by 0 days.

(21) Appl. No.: 12/146,326

(22) Filed: Jun. 25, 2008

(51) Int. Cl.
*B63B 35/44* (2006.01)

(52) U.S. Cl. ..... 114/263; 114/266; 114/267; 405/219; 405/221

(58) Field of Classification Search ..... 114/263, 114/264, 266, 267, 220; 405/218, 219, 220, 405/221
See application file for complete search history.

(56) References Cited

U.S. PATENT DOCUMENTS

| | | | | | |
|---|---|---|---|---|---|
| 3,279,141 | A * | 10/1966 | Schmidt | ..... | 405/218 |
| 3,760,754 | A * | 9/1973 | Drummond et al. | ..... | 114/266 |
| 4,260,293 | A * | 4/1981 | Peterson | ..... | 114/267 |
| 4,660,495 | A * | 4/1987 | Thompson | ..... | 114/263 |
| 4,709,647 | A * | 12/1987 | Rytand | ..... | 114/267 |
| 4,867,093 | A * | 9/1989 | Sullivan | ..... | 114/267 |
| 4,940,021 | A * | 7/1990 | Rytand | ..... | 114/267 |
| 5,584,606 | A * | 12/1996 | Hoogasian, Jr. | ..... | 405/221 |
| 5,845,594 | A * | 12/1998 | Hallsten et al. | ..... | 114/263 |
| 6,205,945 | B1 * | 3/2001 | Passen et al. | ..... | 114/267 |
| 6,230,644 | B1 * | 5/2001 | Passen et al. | ..... | 114/263 |
| 6,431,794 | B1 * | 8/2002 | Zweber | ..... | 405/221 |
| 6,796,262 | B2 * | 9/2004 | Moses | ..... | 114/263 |
| 7,213,531 | B2 * | 5/2007 | Ahern | ..... | 114/263 |
| 2009/0110487 | A1 * | 4/2009 | Hawkins et al. | ..... | 405/220 |

OTHER PUBLICATIONS

Boat Docks; Website Article; http://www.waterventures.net; (2 pages).
SteelDeck An Environmentally Sound, Lifetime Surface for your Dock; Website Article; http://premiermaterials.com; (2 pages).
Connect-a-Dock Construction; Website Article; http:// lakemarineconstruction.com; (7 pages).
EZ Docks; Website Article; http://tmpmarine.com; (2 pages).
Candock Floating Dock System; Website Article; http:// tmpmarinecom; (2 pages).
Shoremaster Waler System Concrete Floating Docks; Website Article; http://tmpmarine.com; (4 pages).

(Continued)

*Primary Examiner*—Lars A Olson
(74) *Attorney, Agent, or Firm*—Stetina Brunda Garred & Brucker

(57) ABSTRACT

There is provided a dock having a pair of primary frame members and a pair of secondary frame members. The primary and secondary frame members are formed of a fiber-reinforced resin material. The primary frame members extend parallel to a primary axis and are arranged in opposed, spaced parallel relation to each other. Likewise, the secondary frame members extend parallel to a secondary axis and are arranged in opposed, spaced parallel relation to each other. Each secondary frame member is connected to the pair of primary frame members. The dock also includes a plurality of cross members. Each cross member is connected to and extends between the pair of primary frame members. Each cross member includes an upper platform contact face disposed within a common upper platform contact plane.

17 Claims, 14 Drawing Sheets

OTHER PUBLICATIONS

Flotation Systems, Inc.; Catalog for Aluminum Boat Docks; (15 pages), Aug. 14, 2008.
Boat Dock Construction; Website Article; http://www.aluminumboatdocks.com; (2 pages), Aug. 14, 2008.
Anchoring Systems; Website Article; http://www.aluminumboatdocks.com; (4 pages), Aug. 14, 2008.
Marina and Dock Applications; Website Article; http://www.strongwell.com; (2 pages), Aug. 13, 2008.
Mod-U-Dock Modular Boat Docks; Website Article; http://www.modudock.com; (7 pages), Aug. 13, 2008.
Piers, Docks; Website Article; http://www.aqualandmfg.com; (3 pages), Aug. 13, 2008.
Borel Docks—Marine Construction; Website Article; http://www.boreldocks.com; (2 pages), Aug. 13, 2008.
Florida Pier Construction; Website Article; http://www.dalesmarine.com; (1 page), Aug. 14, 2008.
Information About Docks and Sea Walls; Website Article; http://www.innerbanks.biz; (2 pages), Aug. 14, 2008.
GatordDock: Floating Docks; Website Article; http://www.cmiwaterfront.com; (2 pages), Aug. 14, 2008.

* cited by examiner 54
56
56
38
52
22
44
32
72
72
32
12

32
22
26
38
28
12
2A
34
32
2A
2B
2B
12
34
32
16
32
18
20
92
32
90
32
98
98
104
32
22
32
96
114
104
118
104
122
120
12
32
44
72
73
114
104
104
114
104
12

DOCK SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Field of the Invention

The present invention relates generally to a lightweight and durable dock and/or pier having a twin-fin float system and components formed of pultruded materials.

2. Description of the Prior Art

It is well-known that docks are man-made structures that extend from shore over a body of water. Docks are commonly employed to provide a walkway from the shore to a boat, which may be tethered to a post or piling adjacent the dock. In addition, docks may be used as a location to swim from, as well as a spot to relax and enjoy the nautical scenery.

It is common for water levels to fluctuate. For instance, the ocean tides cause the water levels to vary along an ocean coastline, and the release or retaining of water within a reservoir may also alter the reservoir's water level. Consequently, it may be desirable for docks to accommodate changes in the water level. One way docks commonly account for the changing water levels is to connect the dock to a float system. In this manner, as the water levels fluctuate, the dock remains floating on the surface of the water. A gangway may extend from the shore to the floating portion of the dock to provide a pathway thereto.

Many existing floating docks are constructed using a wood frame. The wood frame may be connected to an upper walking surface fabricated from a wood, concrete, or plastic material. Although wood is a commonly used construction material, it is very heavy compared to the weight of modern composite material. Thus, it may be problematic in relation to a floating dock. In particular, the wood may splinter, which may cause harm to anyone walking over the dock in their bare feet, which tends to occur when someone is swimming off of the dock. Furthermore, the screws or nails holding the wood together may protrude through the wood, thereby creating a safety hazard. The screws or nails may also fall out of the wood, which tends to weaken the structural integrity of the dock. In addition, the wood is liable to further structural weakening caused by termite infestation or rotting of the wood.

An additional drawback with most wood-framed docks is that they are typically custom-built for the specific user. In this manner, a considerable amount of time is spent designing and constructing the dock, which usually increases the cost thereof.

Another common material employed to construct floating docks is concrete. Although concrete is a regularly used construction material, there may be some drawbacks to using it to construct a floating dock, especially when the dock is used over a body of water having fluctuating water levels (i.e. ocean or reservoir). During low tide, portions of the concrete dock may come in contact with the shore, while other portions may remain floating. Consequently, the dock may be placed under stress, which may cause cracking in the concrete. If the concrete cracks, salt water may seep into the dock and weaken the structural integrity thereof.

Floating docks are also readily formed of a metallic material, particularly in freshwater conditions. Metallic floating docks are undesirable in saltwater because of corrosion problems. However, even in freshwater, metal docks may bend when the level of the water decreases to the point that the portions of the dock are resting on the shore, while other portions remain floating (as may be the case in a reservoir). Although the metal may have a certain amount of elasticity enabling the dock to reflex to a relatively straight configuration, if the dock bends beyond a certain point, the bend in the dock may be permanent.

Regardless of the material used to construct the floating dock, after construction, the floating dock is deployed in the body of water. The floating dock is typically restrained from movement to prevent the dock from floating away. A regularly used restraining technique is to design the dock to include a hole for allowing a piling to protrude therethrough. The pilings typically restrain the dock from floating away.

In rough conditions, waves may cause the dock to rise and fall along the pilings. Therefore, floating docks commonly include one or more rigid rollers to facilitate upward and downward movement of the dock relative to the piling. However, there is generally a small amount of clearance between the roller and the piling. Therefore, under rough conditions, the rollers may crash with the pilings, which typically results in banging and instability of the dock. Furthermore, the float systems connected to the docks are typically designed with the intention of simply keeping the dock floating, as opposed to enhancing the stability of the dock.

As is apparent from the foregoing, there exists a need in the art for an improved dock configuration. The present invention addresses this particular need, as will be discussed in more detail below.

BRIEF SUMMARY

There is provided a dock having a pair of primary frame members and a pair of secondary frame members. The primary and secondary frame members are formed of a fiber-reinforced resin material. The primary frame members extend parallel to a primary axis and are arranged in opposed, spaced parallel relation to each other. Likewise, the secondary frame members extend parallel to a secondary axis and are arranged in opposed, spaced parallel relation to each other. Each secondary frame member is connected to the pair of primary frame members. The dock also includes a plurality of cross members. Each cross member is connected to and extends between the pair of primary frame members. Each cross member includes an upper platform contact face disposed within a common upper platform contact plane.

The primary and secondary frame members may be formed by a pultrusion process, which tends to produce frame members that are lightweight and durable. The pultrusion formed frame members are unlikely to splinter or crack like convention wood dock frames. In addition, the pultrusion formed frame members may be formed in standard sizes to facilitate assembly of the dock.

The dock may also include a plurality of joint supports. Each joint support may include a primary joint face connected to one of the primary frame members and a secondary joint face connected to one of the secondary frame members. An adhesive may be disposed between each joint support and the respective primary and secondary frame members. Each joint support may include a plurality of joint holes disposed within the primary and secondary joint faces. A sufficient amount of adhesive may be disposed between each joint support to cause the adhesive to flow through and be disposed within at least one of the plurality of joint holes. Each joint support may also include a joint platform contact face disposed within a common upper platform contact plane.

The dock may also include an upper platform formed of a fiber-reinforced resin material. The upper platform may be formed by a pultrusion process. The upper platform may include an upper walking portion and a lower contact surface disposed in contact with each upper platform contact face. The upper platform may be connected to each upper platform contact face via double backed adhesive tape, or other composite adhesives or mechanical fasteners. The upper platform may include a plurality of inter-connected upper platform elements. The upper platform elements may form a monocoque support structure having enhanced strength and rigidity.

There is also provided a float system for use with a dock. The float system includes a floatation shell having opposing shell lateral portions. The floatation shell defines a floatation cavity and is disposable beneath a lower water facing surface of the dock. The floatation shell includes a shell base and a pair of opposing floatation fins. The floatation fins extend away from the shell base to define respective fin distal portions. Each flotation fin is disposed adjacent a respective one of the opposing shell lateral portions. Each fin includes a fin medial face and a fin lateral face defining a fin width therebetween. The fin width decreases from the shell base towards the fin distal portion. The size and configuration of the floatation shell, including the shell base and floatation fins, may be varied to accommodate the floatation characteristics desired in the particular dock system to which it is being used. For instance, the size and configuration of the floatation shell may be varied to achieve a desired freeboard height, or buoyant support for the dock.

The floatation shell may include a pair of floatation elements that collectively define the floatation shell. Each floatation element may include a respective one of the pair of opposing floatation fins. A buoyant element may be disposed within the floatation cavity to increase the buoyancy of the float system. An attachment flange having a plurality of fastener openings may be connected to the floatation shell to enable attachment to the dock.

There is further provided a roller for use on a dock positioned near a piling. The roller includes a spring biased bracket having a dock contact portion engageable with the dock. The dock contact portion includes a dock contact upper surface. The bracket also includes a bracket sidewall having a sidewall lower edge. The sidewall lower edge and the dock contact upper surface define a bracket angle. The spring biased bracket is moveable between a compressed position and an extended position, wherein the bracket angle increases as the spring biased bracket moves from the compressed position to the extended position. The spring biased bracket is biased towards the extended position. The roller also includes a wheel rotatably connected to the bracket sidewall. The wheel is engageable with the piling.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1A:
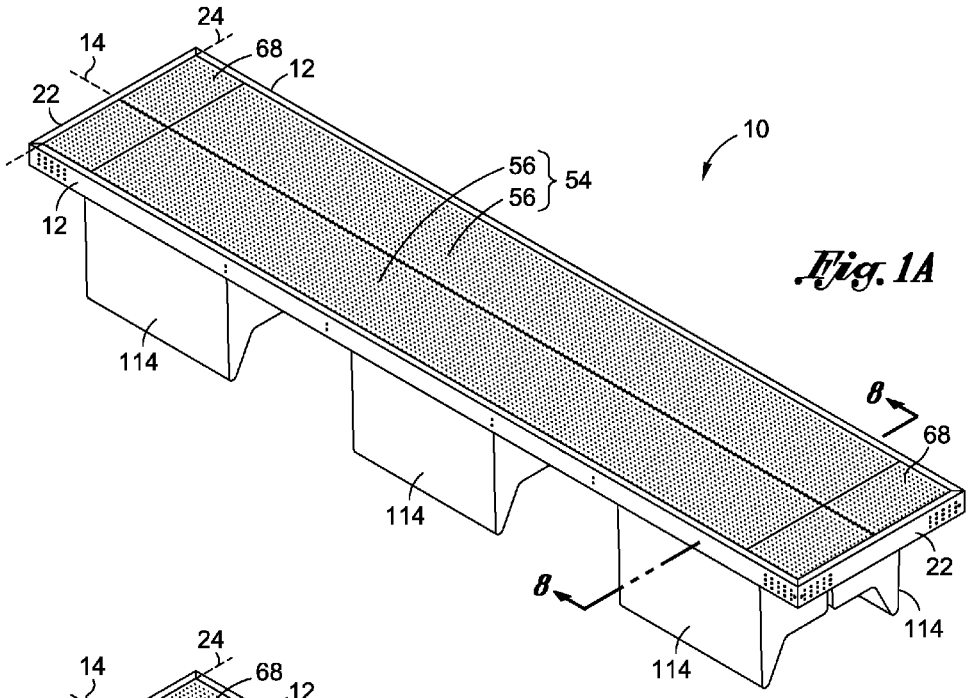
FIG. 1A is an upper perspective view of a dock constructed in accordance with an aspect of the present invention.

Referring now to the drawings where the showings are for purposes of illustrating a preferred embodiment of the present invention only, and not for purposes of limiting the same, there is shown a dock 10 constructed in accordance with an embodiment of the present invention. The dock 10 includes a pair of primary frame members 12 extending along a length thereof. According to one implementation, each primary frame member 12 includes a primary upper flange 16, a primary lower flange 18, and a primary wall 20 extending between the primary upper and lower flanges 16, 18. In one embodiment, the primary upper flange 16 defines a primary upper edge and the primary lower flange 18 defines a primary lower edge 18. The primary frame members 12 extend along a primary axis 14 and are arranged in opposed, spaced parallel relation to each other. In this manner, the primary walls 20 of the respective primary frame members 12 may be facing each other.

The dock 10 also includes a pair of secondary frame members 22. In one embodiment, the secondary frame members 22 each include a secondary upper flange 26, a secondary lower flange 28, and a secondary wall extending therebetween. The secondary upper flange 26 may define a secondary upper edge and the secondary lower flange 28 may define a secondary lower edge. The secondary frame members 22 extend along a secondary axis 24 and are arranged in opposed, spaced parallel relation to each other. In this regard, the secondary walls of the respective secondary frame members 22 may be facing each other.

It may be desirable to form the primary frame members 12 and the secondary frame members 22 of a pultruded material. As used herein, a pultruded material is a material having one or more reinforcing fibers. Pultruded materials tend to be stronger, durable, and/or more lightweight than conventional dock materials (e.g. wood or metal). In one particular embodiment, the primary frame members 12 and the secondary frame members 22 are constructed of a fiber-reinforced resin material formed by a pultrusion process. The fiber-reinforced resin material may include, but is not limited to, fiber-reinforced fiber glass. Although the frame member 12, 22 are formed of pultruded materials in one embodiment, the frame members 12, 22 may be formed of extruded materials, or other materials known by those skilled in the art in another embodiments.

The primary and/or secondary frame members 12, 22 may be connected to a bumper 52 to mitigate damage caused by contact with a boat positioned adjacent the dock 10. The bumper 52 may be formed of a resilient material, such as rubber, capable of withstanding repeated contact with an adjacent boat.

In the embodiment shown in FIG. 1, the secondary frame members 22 are arranged orthogonally to the primary frame members 12. In other words, the secondary axis 24 is perpendicular to the primary axis 14. It is understood that other embodiments may include primary and secondary frame members 12, 22 that are arranged in a non-orthogonal configuration.

The secondary frame members 22 are connected to the primary frame members 12. More specifically, each secondary frame member 22 is connected to both primary frame members 12. Likewise, each primary frame member 12 is connected to both secondary frame members 22. The primary and secondary frame members 12, 22 may be connected to each other in abutting or non-abutting configurations. In other words, the primary and secondary frame members 12, 22 may be directly connected to each other, or an intermediate connection element may be used.

Figures 3, 4, 5:
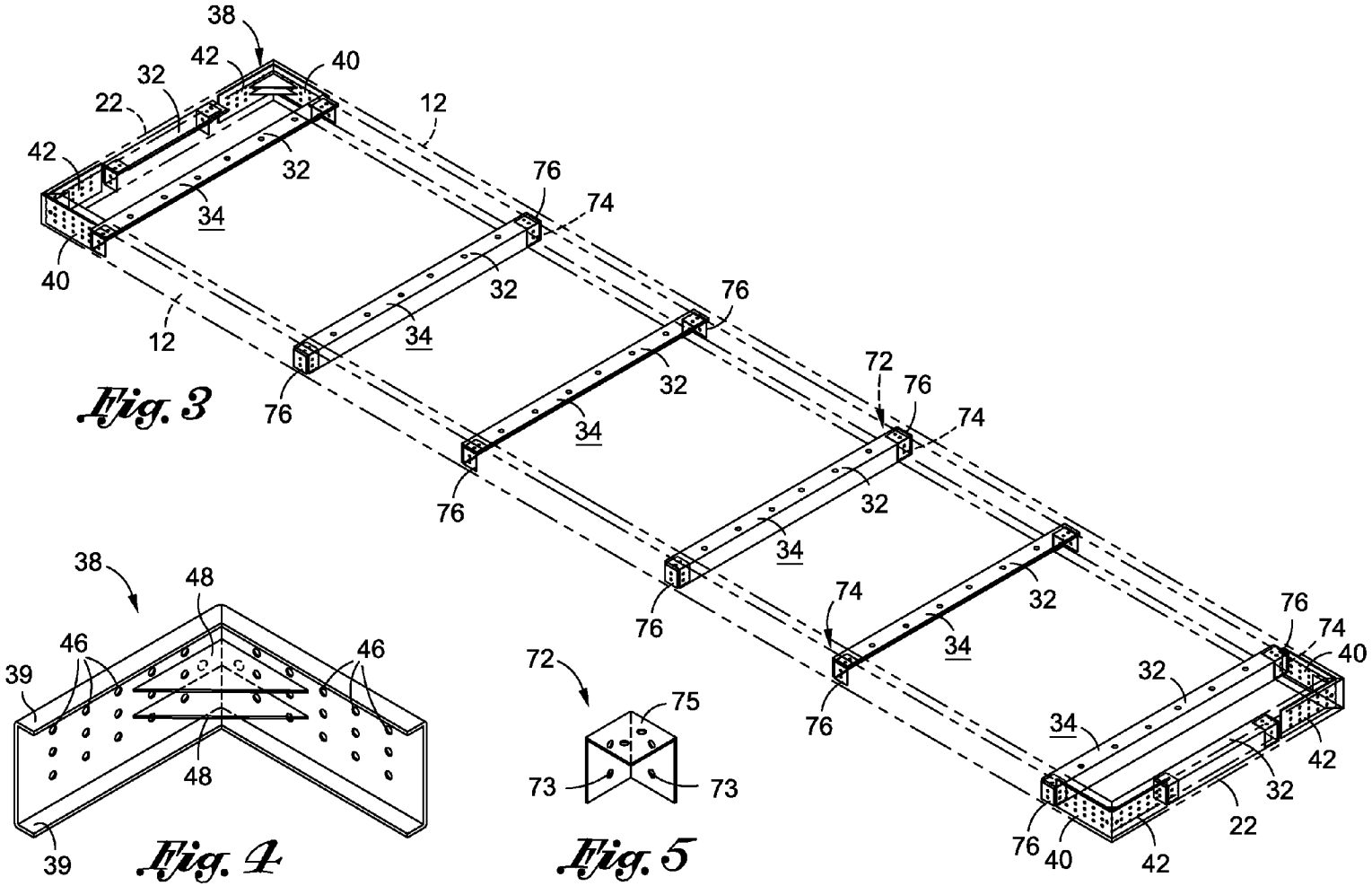
FIG. 3 is an upper perspective view of a plurality of cross members disposed between and connected to opposing primary frame members by the cross member connector, each primary frame member being connected to a pair of secondary frame members via a joint support.
FIG. 4 is an upper perspective view of the joint support.
FIG. 5 is an upper perspective view of the cross member connector.

According to one embodiment, the primary and secondary frame members 12, 22 are connected via joint supports 38. As best illustrated in FIG. 3, the dock 10 includes a joint support 38 disposed in each corner to connect adjacent primary and secondary frame members 12, 22. In one embodiment, the joint supports 38 are constructed of corrosion resistant steel. Each joint support 38 includes a primary joint face 40 that is connected to a respective primary frame member 12 and a secondary joint face 42 that is connected to a respective secondary frame member 22. The joint supports 38 shown in FIGS. 3 and 4 include primary and secondary joint faces 40, 42 arranged substantially orthogonally relative to each other. Consequently, when the primary and secondary frame members 12, 22 are connected to the joint support 38, the primary and secondary frame members 12, 22 are also arranged substantially orthogonal to each other. Therefore, if a non-orthogonal connection between the primary and secondary frame members 12, 22 is desired, a joint support 38 having primary and secondary joint faces 40, 42 arranged in a non orthogonal orientation may be used.

The joint supports 38 may also include a joint support flange 39. The joint support flange 39 may interface with the primary upper and lower flanges 16, 18 of the primary frame member 12, as well as the secondary upper and lower flanges 26, 28 of the secondary frame member 22 to provide additional structural support.

The joint support 38 may be connected to the respective primary and secondary frame members 12, 22 by a high-strength adhesive. In this manner, the adhesive is disposed between the primary joint face 40 and the respective primary frame member 12, as well as between the secondary joint face 42 and the secondary frame member 22. A mechanical fastener (not shown) may be used to temporarily connect the joint support 38 to the primary and secondary frame members 12, 22 while the adhesive cures.

The joint support 38 may also include a plurality of flow channels or joint holes 46 as illustrated in FIG. 4. The joint holes 46 may be located in the primary joint face 40, the secondary joint face 42, as well as in the corner of the joint support 38. The adhesive disposed between the joint support 38 and the primary and secondary frame members 12, 22 may flow or ooze through the flow channels/joint holes 46 when the joint support 38 is pressed against the primary and secondary frame members 12, 22 before the adhesive cures. More specifically, the adhesive may be applied to the primary and secondary joint faces 40, 42 and/or the primary and secondary frame members 12, 22. When the joint support 38 is pressed against the respective primary and secondary frame members 12, 22, the adhesive may flow or ooze into the holes 46. In effect, the adhesive oozing through the holes 46 acts as a rivet or other mechanical fastener adding strength of multiple conventional fasteners to each joint. The oozing adhesive further enhances the strength of the connection in shear.

The primary and secondary frame members 12, 22 may be configured to support an upper surface for users to walk on. To this end, one embodiment of the dock 10 includes a plurality of cross members 32. Many of the cross members 32 are connected to and extend between the pair of primary frame members 12. More specifically, each of such cross members 32 includes opposing end portions that are connected to a respective primary frame member 12. The dock 10 may also include cross members 32 disposed adjacent the end portions of the dock 10 that are smaller in length than the intermediate cross members 32. In this regard, the cross members 32 disposed adjacent the end portion may not fully extend between the pair of primary frame members 12.

In the embodiment shown in FIG. 3, the cross members 32 are substantially orthogonal to the primary frame members 12. However, the cross members 32 may be disposed in a non-orthogonal orientation relative to the primary frame members 12 without departing from the spirit and scope of the present invention.

Each cross member 32 includes an upper platform contact face 34 disposed within a common upper platform contact plane. The upper platform contact faces 34 collectively form a support upon which an upper walking surface may be disposed. In this manner, it may be desirable that the upper platform contact faces 34 are substantially level to evenly support the upper walking surface.

The dock 10 may include a cross member bracket 72 for connecting a respective cross member to one or more frame members 12, 22. Each cross member 32 may rest on the cross member bracket 72, with no adhesive or fastener engaging the cross member bracket 72 to the cross member 32. This may allow the cross member 32 to be easily removed from the cross member bracket 72, which may be desirable to provide access to the underside of the dock 10, where utilities may be located. However, it is understood that other embodiments include an adhesive or fastener to secure the cross member 32 to the cross member brackets 72.

As shown in FIG. 3, the plural intermediate cross members 32 are connected to the primary frame members 12 by cross member connectors 72. Each cross member connector 72 includes a cross member contact face 74, a primary contact face 76, and a connector upper surface 75 extending between the cross member contact face 74 and the primary contact face 76. The primary contact face 76 is connected to a respective primary frame member 12. The cross member connector 72 may be connected to the primary wall 20 between the primary upper and lower flanges 16, 18. The cross member 32 may be disposed on two cross member connectors 72 connected to respective primary frame members 12. More specifically, the cross member 32 may rest on the connector upper surfaces 75 of the cross member connectors 72.

In one embodiment, a high strength adhesive is used to join the cross member connector 72 to the respective cross member 32 and primary frame member 12. The high strength adhesive may be the same high strength adhesive used to connect the joint support 38 to respective primary and secondary frame members 12, 22. A mechanical fastener may be used to temporarily connect the cross member connector 72 to the cross member 32 and the primary frame member 12 while the high strength adhesive cures. The cross member connector 72 may include one or more cross member holes 73 similar to the joint holes 46 in the joint support 38, as described above. The adhesive may be caused to be disposed within the cross member holes 73 to enhance the connection between the cross member connector 72, the cross member 32, and the primary frame member 12. Although the foregoing describes use of an adhesive to connect the cross member connector 72 to the cross member 32 and the primary frame member 12, it is understood that other fasteners known by those skilled in the art may also be used.

According to other aspects of the present invention, additional support for an upper walking surface may be provided by the joint support 38. Referring again to the join support 38 depicted in FIG. 4, various embodiments of the joint support 38 may include a joint platform contact face 48 for providing such additional support. As shown, the joint platform contact face 48 extends between the primary and secondary joint faces 40, 42. Although a pair of joint platform contact faces 48 are shown in the joint support 38 depicted in FIG. 4, only one of the joint platform contact faces 48 may support an upper walking surface; however the pair of joint platform contact faces 48 makes the joint support 38 universal and disposable within any corner of the dock 10, as described in more detail above. When the joint support 38 is disposed within a respective corner of the dock 10, the upper joint platform contact face 48 is disposed within the common upper platform contact plane.

The dock 10 may include an upper platform 54, as shown in FIGS. 1, 2, 6A and 6B. The upper platform 54 includes an upper walking portion 58 and a lower contact element 60 that is disposable in contact with the upper platform contact faces 34 of the cross members 32. The upper platform 54 may be connected to each upper platform contact face 34 by double backed adhesive tape 70. Furthermore, the lower contact element 60 may also be disposable in contact with the joint platform contact face 48 for additional support.

It is contemplated that a large upper platform 54 may be required to provide an upper walking surface for a single dock 10. Therefore, the upper platform 54 may include one or more upper platform elements 56. The upper platform elements 56 collectively define the upper platform 54. It is understood that upper platform elements 56 that vary in size may be used to form the upper platform 54. In this manner, various upper platform elements 56 may be used which vary in length and width in order to accommodate the desired dimensions of the user.

Figure 6A:
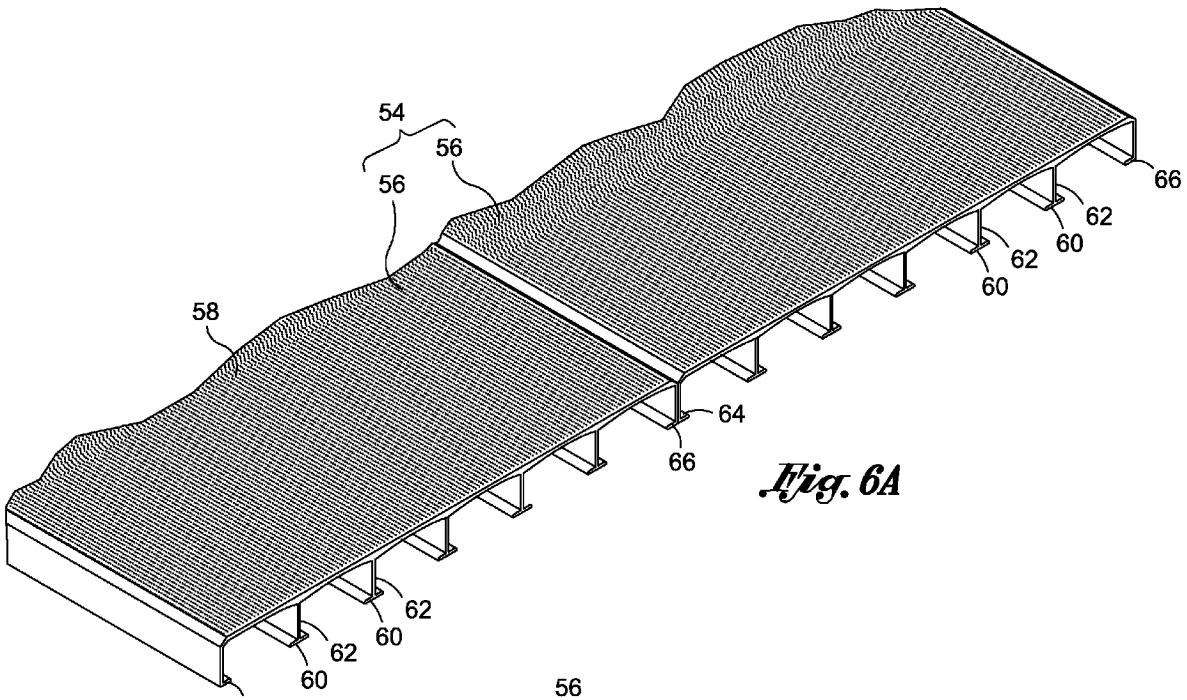
FIG. 6A is an upper perspective view of a portion of an upper platform, the upper platform including two upper platform elements.
Figure 6B:
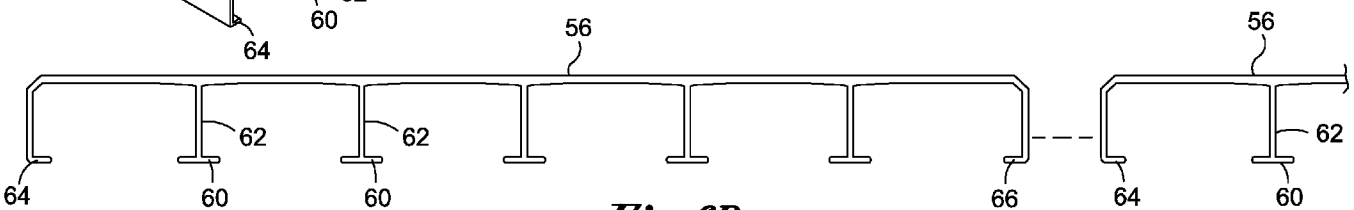
FIG. 6B is a side view of the upper platform elements.

In the embodiments shown in FIGS. 6A and 6B, each upper platform element 56 includes a plurality of upper platform ribs 62 extending from the upper walking portion 58 and terminating in a respective lower contact element 60. As illustrated, the upper platform ribs 62 extend generally orthogonally from the upper walking portion 58 with the lower contact element 60 being disposable in contact with the cross members 32. Each lower contact element 60 may be connected to one or more cross member 32 by double backed adhesive tape or other adhesives or mechanical fasteners. In this regard, each lower contact element 60 may extend along the length of the upper platform element 56 to connect with multiple cross members 32. As such, each upper platform element 56 may be connected to a plurality of cross member 32 to create a monocoque construction of the upper platform 54 to enhance the structural integrity thereof. In other words, each upper platform element 56 supports adjacent upper platform elements 56 to improve the overall rigidity and strength of the upper platform 54.

According to one implementation of the invention, the upper platform 54 is formed of a fiber-reinforced resin material and is formed by a pultrusion process. In addition, it is also contemplated that the cross members 32 may also be formed of a fiber-reinforced resin material that may be pultruded. However, the upper platform 54 and cross members 32 may also be formed of extruded materials, or other materials known by those skilled in the art.

It is contemplated that the upper platform 54 may include one or more removable end pieces 68 to allow access to items underneath the upper platform 54. The embodiment illustrate in FIG. 1 includes four removable end pieces 68 disposed adjacent the end portions of the dock 10 (the embodiment shown in FIG. 2 does not include removable end pieces 68). In one embodiment, the removable end pieces 68 are connected to joint support 38 and/or cross member 32 by commercial post and post double backed tape or other mechanical fasteners. One supplier of post and post double backed tape is the 3M Company headquartered in Maplewood, Minn. In another embodiment, the removable end pieces 68 simply rest on a support, such as the joint support 38 and/or cross member 32, without being fixedly connected thereto to enable easy removal thereof.

Figure 7:
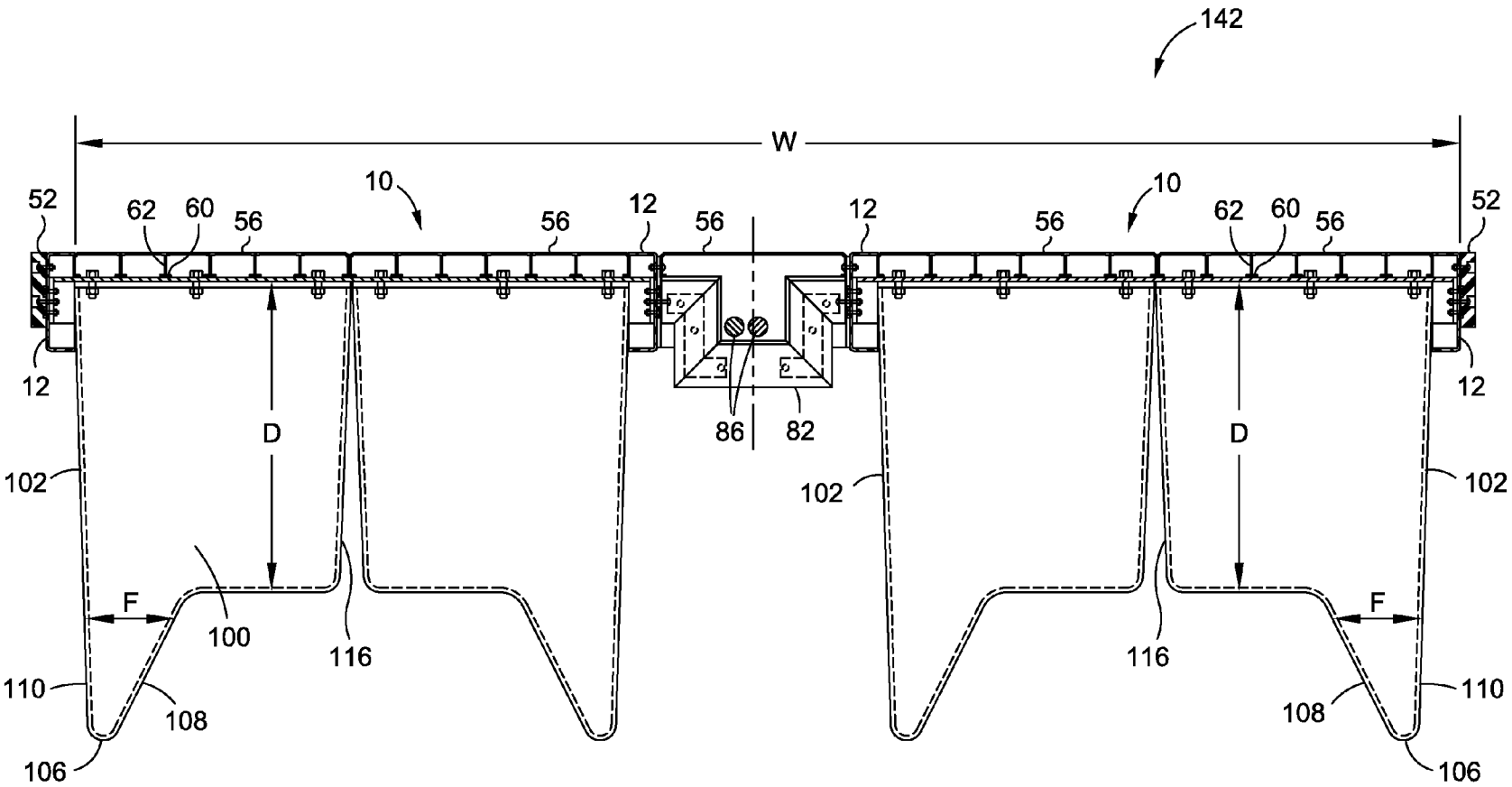
FIG. 7 is an end view of an embodiment of the dock assembly, wherein adjacent docks are connected by a medial connector.

It is common for utilities 86 to extend under a dock 10. Such utilities 86 may include, but are not limited to, potable water, sewage, fire water, electricity, cable and telephone services. Therefore, referring to now to FIG. 7, one embodiment of the present invention includes a dock assembly 142 including a pair of adjacent docks 10. The docks 10 are connected by a medial connector 82 sized and configured to provide a channel for utilities 86. The medial connector 82 may be connected to a opposing frame members 12, 22 of the adjacent docks 10. In particular, the medial connector 82 may be connected to opposing primary frame members 12 on docks 10 connected side-by-side.

The medial connector 82 may also be desirable in docks 10 having a large dock width "W." As used herein, the dock width W is equal to the distance between the primary frame members 12. A greater width W may be achievable by connecting a pair of docks 10 together via a medial connector 82. However, other connection means may also be used, as described in detail below.

According to another aspect of the present invention, the dock 10 is modular to allow for easy assembly thereof. To this end, many of the components may be prefabricated to enable on-site assembly of the dock 10. A modular dock generally requires less time to assemble, and is cheaper to manufacture and transport. In one particular embodiment, the primary frame member 12, secondary frame member 22, cross members 32, and upper platform elements 56 may be formed of standard dimensions. The components may be available to construct a dock 10 that is 20'×3', 20'×4', 20'×6', and 20'×8'. Such standard dock sizes are exemplary in nature and are not intended to limit the scope of the present invention. Although the foregoing describes a module dock design, it is also understood that a custom dock 10 having dimensions that differ from the standard sizes may also be constructed without departing from the spirit and scope of the present invention.

Figure 8:
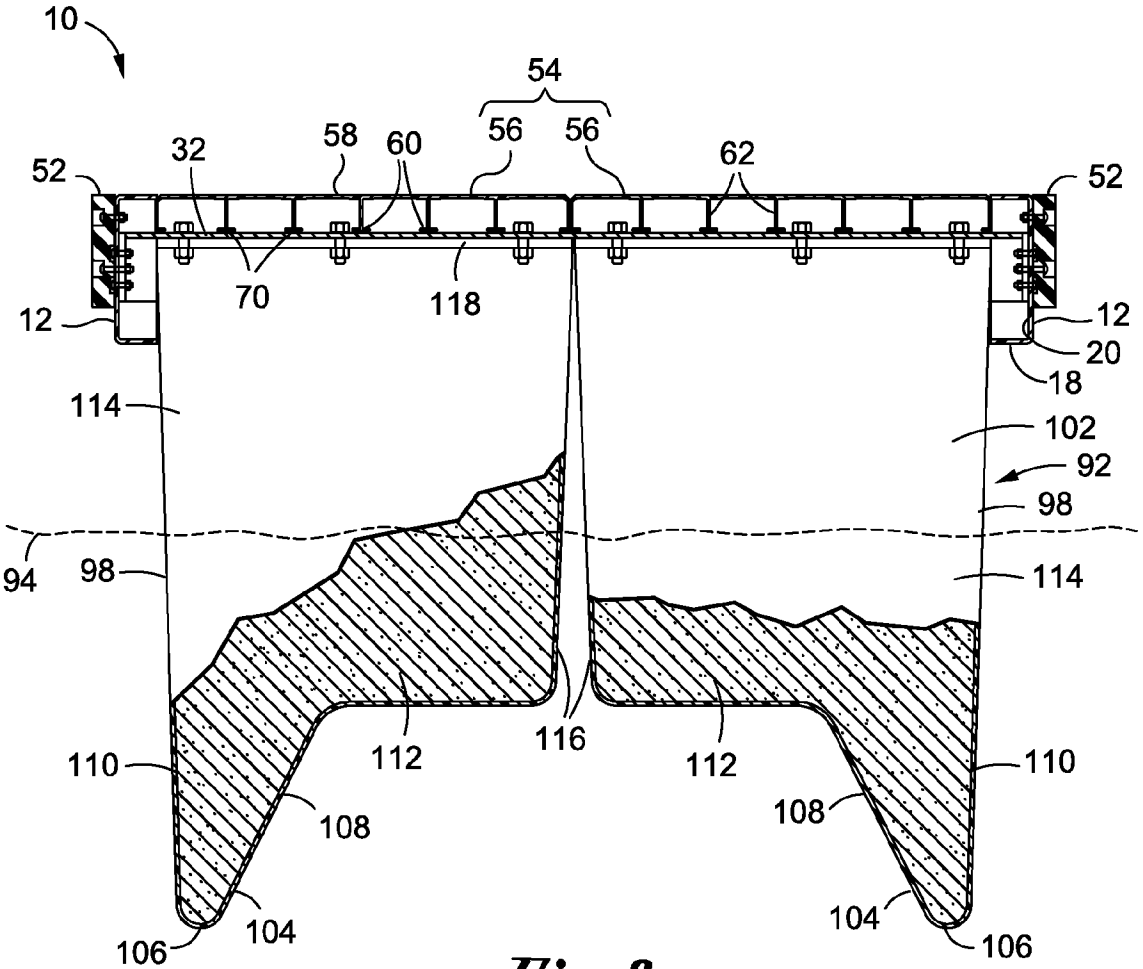
FIG. 8 is a side sectional view of the dock having a float system including a pair of floatation elements, each floatation element having a floatation fins extending from a lateral portion thereof.

Referring now to FIG. 8, various aspects of the present invention are directed toward a float system 90 for use with the dock 10. The float system 90 is intended to provide a buoyant force to the dock 10 to keep the upper walking portion substantially above the body of water 94. The float system 90 includes a floatation shell 92 that is disposable beneath a water facing surface 96 of the dock 10. In one particular embodiment, a low density polyurethane foam is used to cast the basic shape of the floatation shell 92. After curing for a few seconds, the floatation shell 92 is sheathed with a high density polyurethane skin. In another embodiment, the floatation shell 92 is formed of a polyethylene sheath containing an expanded polystyrene core.

The floatation shell 92 includes a shell base 102 having a shell base upper surface 103. A pair of opposing floatation fins 104 extends away from the shell base 102 to define respective fin distal portions 106. The distance between the shell base upper surface 103 and the fins 104 is referred to as the shell depth "D." The size of the shell depth D may vary as desired. According to various aspects of the present invention, the shell depth D is deepest at the fin distal portions 106. It may desirable that the floatation fins 104 extend from opposing lateral portions 98 of the floatation shell 92 to increase the stability of the dock 10.

As can be seen from the illustration in FIG. 8, the floatation fins 104 extend from the shell base 102 toward the water 94. Each floatation fin 104 includes a fin medial face 108 and a fin lateral face 110 to define a fin width "F" therebetween. The floatation fin 104 is configured such that the fin width F decreases from the shell base 102 towards the fin distal portion 106. In other words, the fin width F is the smallest at the fin distal portion 106. It is understood that the fin width F may decrease in a uniform or non-uniform manner.

The size and configuration of the floatation shell 92 may be varied to accommodate various weights and dock configurations. For instance, the shell depth D may be increased to provide more buoyancy for a heavier dock. In addition, by altering the shell depth D, the freeboard height may also be altered. As used herein, the freeboard height refers to the distance between the water level and the upper platform 54. In addition to altering the shell depth D, the fin width F may also be altered to enhance the lateral stability of the dock 10.

In the particular embodiment shown in the FIG. 8, the floatation shell 92 includes a pair of floatation elements 114, which collectively define the floatation shell 92. Each floatation element 114 includes a floatation medial face 116 and a floatation lateral face 117. The floatation medial faces 116 of the respective floatation elements 114 are disposed in opposed relation to each other, as best shown in FIG. 8. In this manner, the floatation fins 104 are disposed laterally of the floatation medial face 116.

The floatation shell 92 also defines a floatation cavity 100. According to one embodiment, a buoyant element 112 is disposed within the floatation cavity 100 to enhance the buoyancy of the float system 90. The buoyant element 112 may be constructed out of a foam material, or other buoyant materials known by those skilled in the art.

According to one particular implementation, the floatation shell 92 includes an attachment flange 118 connected to the floatation shell 92. In this manner, the attachment flange 118 may extend from the floatation shell 92. The attachment flange 118 includes one or more fastener openings 120 extending therethrough. The fastener openings 120 may be aligned with openings on the dock 10 to allow a mechanical fastener, such as a bolt to extend therethrough, to attach the floatation shell 92 to the dock 10. As shown in the exploded view in FIG. 2, the fastener openings 120 of the attachment flange 118 are aligned with openings within the cross member 32 of the dock 10.

Although the Figures show a nut and bolt connector for attaching the floatation shell 92 to the dock 10, it is also understood that other fasteners may also be used to attach the floatation shell 92 to the dock 10. For instance, the dock 10 may include a spring biased locking member which may engage with the fastener openings 120 to connect the floatation shell 92 to the dock 10. Alternatively, the floatation shell 92 may include a flange which is engaged within a groove formed within the dock 10 for attachment thereto.

Figures 2, 2A, 2B:
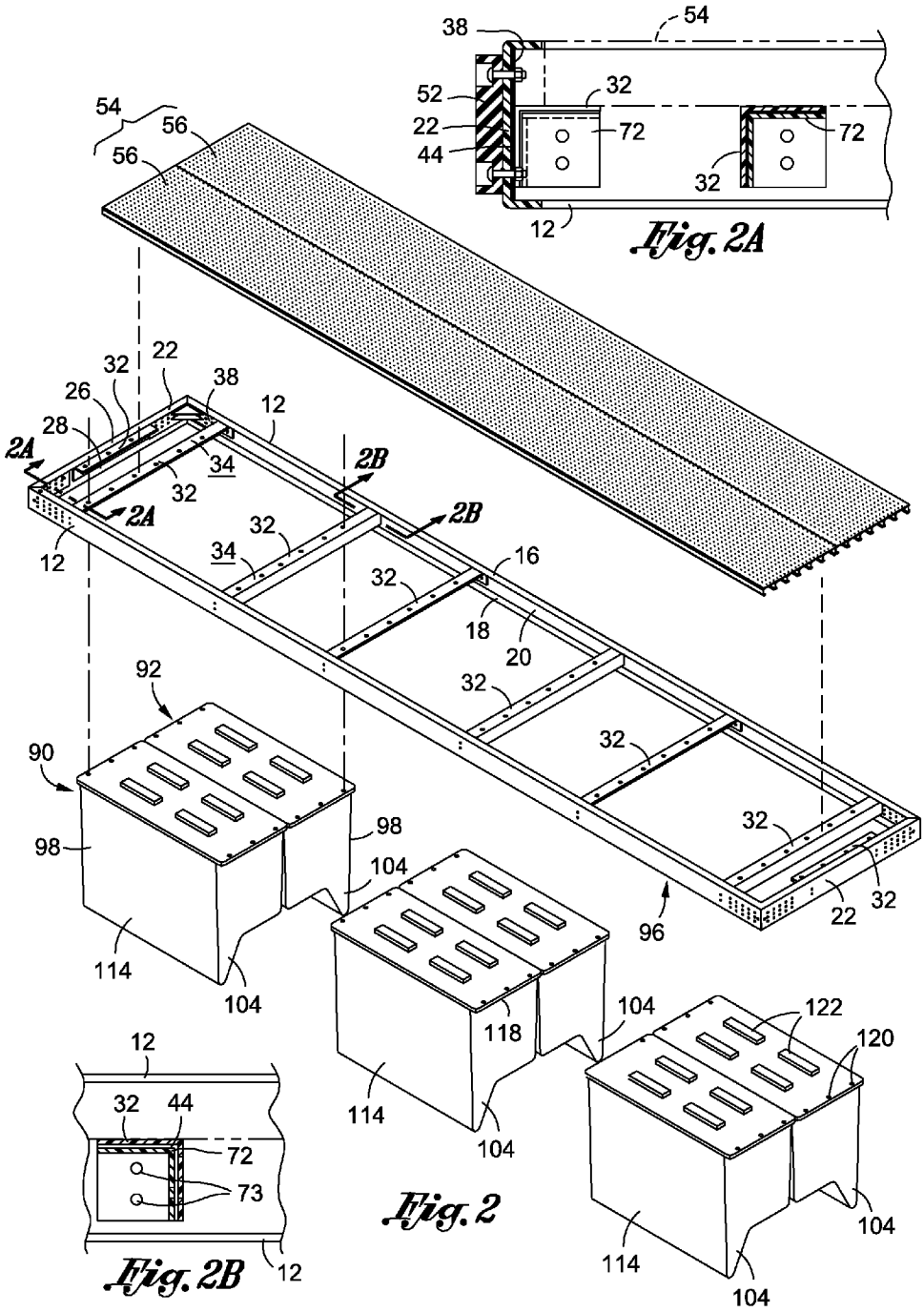
FIG. 2 is an exploded perspective view of the dock illustrated in FIG. 1A.
FIG. 2A is a side sectional view of an end portion of the dock illustrated in FIG. 2.
FIG. 2B is a side sectional view illustrating a cross member connector for connecting a cross member to a primary connector.

The embodiment in FIG. 2 also shows a floatation shell 92 having a plurality of press-fit engagement members 122 extending from the shell base 102. The press-fit engagement members 122 may be configured to engage with the dock 10. The dock 10 may include a dock engagement member that engages with the press-fit engagement member 122. In one implementation, the press-fit engagement members 122 may engage with the upper platform 54. More specifically, individual engagement members 122 may be received between adjacent upper platform ribs 62 to secure the floatation shell 92 to the dock 10.

Figure 8A:
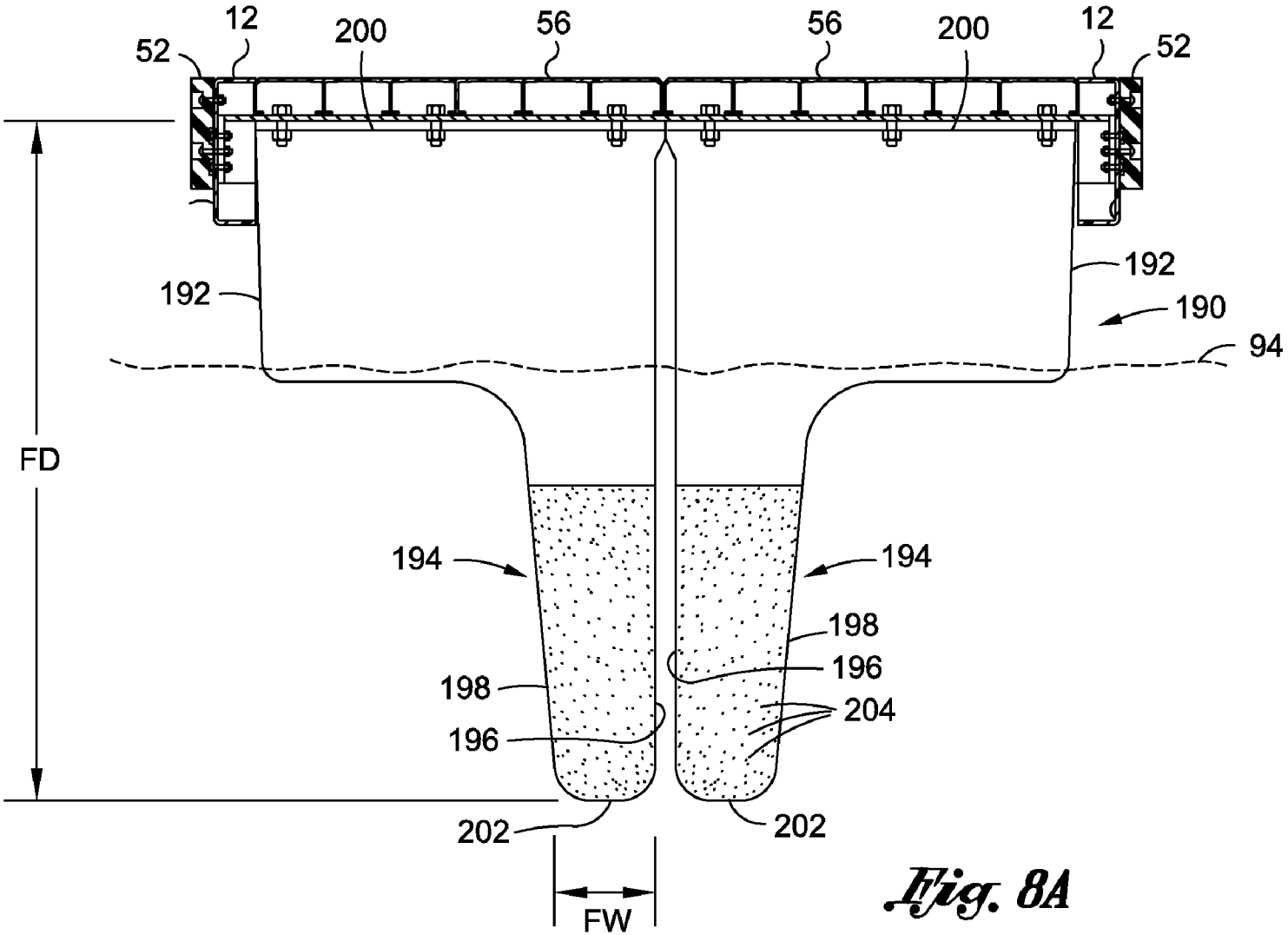
FIG. 8A is a side sectional view of the dock having another embodiment of the float system connected thereto, the float system including a pair of floatation elements, each floatation element having a medial fin filled with sand.
Figure 9:
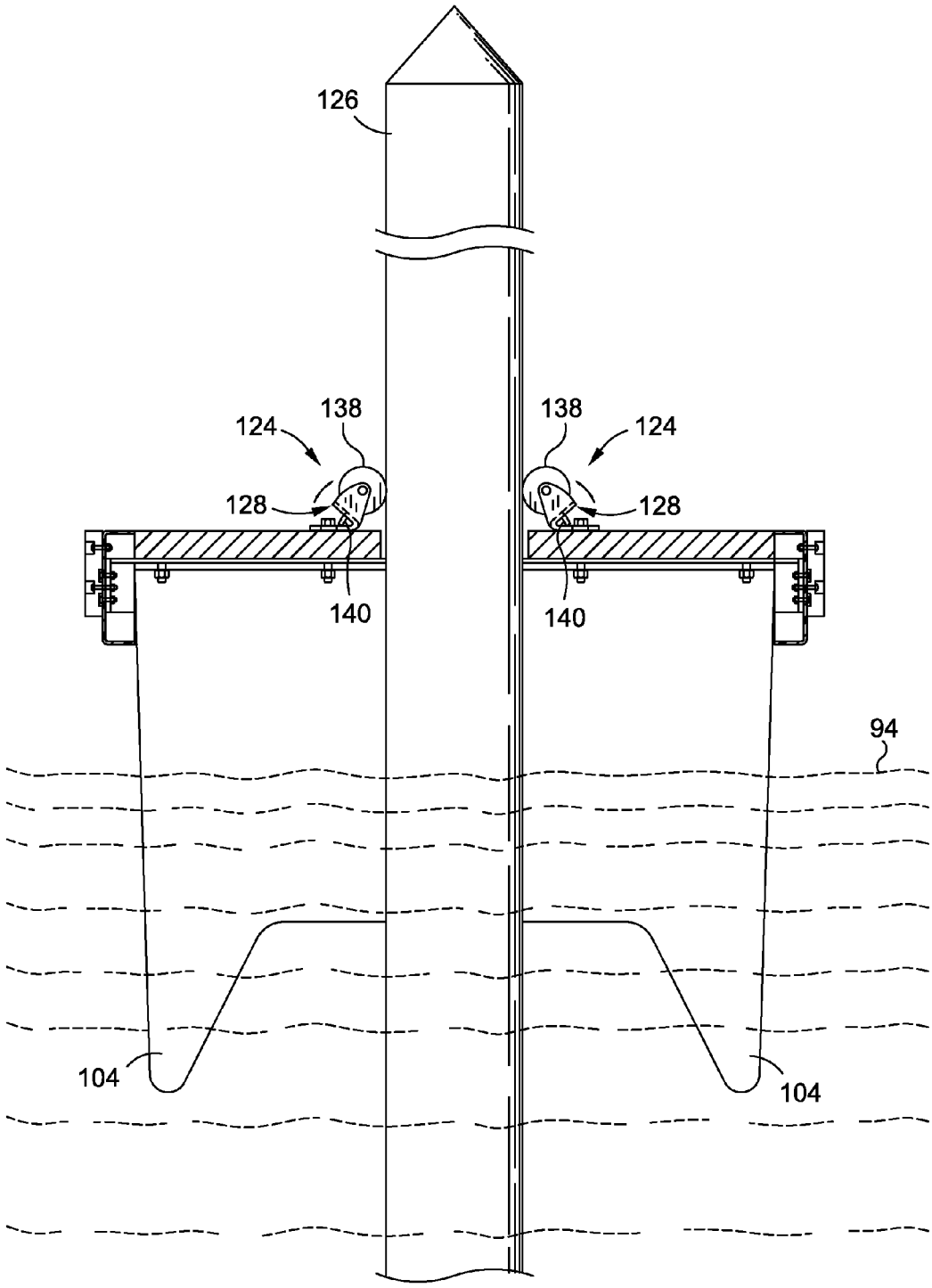
FIG. 9 is a side view of a dock having a pair of opposing rollers engaged with a piling.

The floatation shell 92 depicted in FIG. 8 may be desirable for purposes of wave attenuation. Referring now to FIG. 8A, there is shown another embodiment of the floatation shell 190 which may be more desirable for creating a more stable walking surface. The floatation shell 190 includes a pair of floatation elements 192, each having a medial fin 194 terminating in a fin distal portion 202. In this manner, the fin 194 is disposed under the medial portion of the dock 10, as opposed to the lateral portion of the dock 10. Each floatation element 192 also includes a medial face 196, a lateral face 198 and an upper face 200. The distance between the medial face 196 and the lateral face 198 is referred to herein as the fin width, "FW," while the distance between the upper face 200 and the fin distal portion 202 is referred to as the fin depth, "FD." The fin width FW and fin depth FD may vary to achieve desired floatation characteristics.

The medial fin 194 may be filled with sand 204 or other material known in the art to provide additional weight to the medial fin 194. The additional weight provides more stability to the dock 10. The amount of sand 204 or other material may be varied according to the particular size and weight of the respective dock 10.

As the dock 10 floats in the body of water 94, it is typically restrained to maintain the dock 10 in a desired location. One common technique of restraining the dock 10 is to connect the dock 10 to one or more pilings. In this manner, the dock 10 typically includes one or more a holes through which the pilings 126 protrude. Therefore, as the water currents urge the dock 10 away from its desired location, the protruding pilings 126 keep the dock 10 in place.

In rough water conditions, the dock 10 may traverse up and down the piling 126. The traversal of the dock 10 along the piling 126 may be very unsteady. Furthermore, the waves may cause the dock 10 to crash into the piling 126 under certain conditions, which generally creates a very unstable walking surface. Repeated contact between the dock 10 and the piling 126 may cause damage to the dock 10. Therefore, various aspects of the present invention include a roller 124 for use on a dock 10 positioned near a piling 126. The roller 124 may be configured to provide a smoother traversal of the dock 10 along the piling 126. In addition, the roller 124 may act as a shock-absorber between the dock 10 and the piling 126.

The roller 124 includes a spring biased bracket 128 having a dock contact portion 130 and a bracket sidewall 134. The dock contact portion 130 is engageable with the dock 10 and includes a dock contact upper surface 132. In the embodiment illustrated in FIGS. 11A and 11B, the dock contact portion 130 is disposed in direct contact with the dock 10. The dock contact portion 130 is connected to the dock 10 via a mechanical fastener, such as a screw, nut and bolt, nails, or the like. It is also contemplated that the dock contact portion 130 may be integrally formed with the dock 10.

Figure 11A:
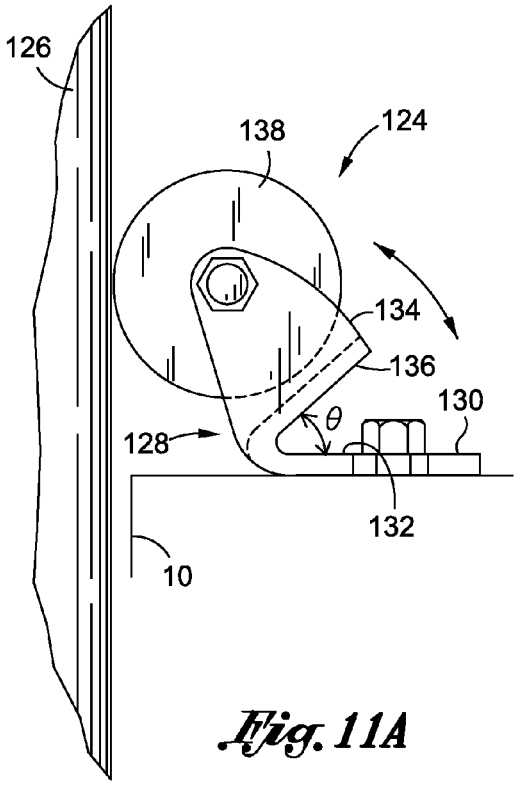
FIG. 11A is a side view of the roller illustrated in FIG. 9 in a compressed position.
Figure 11B:
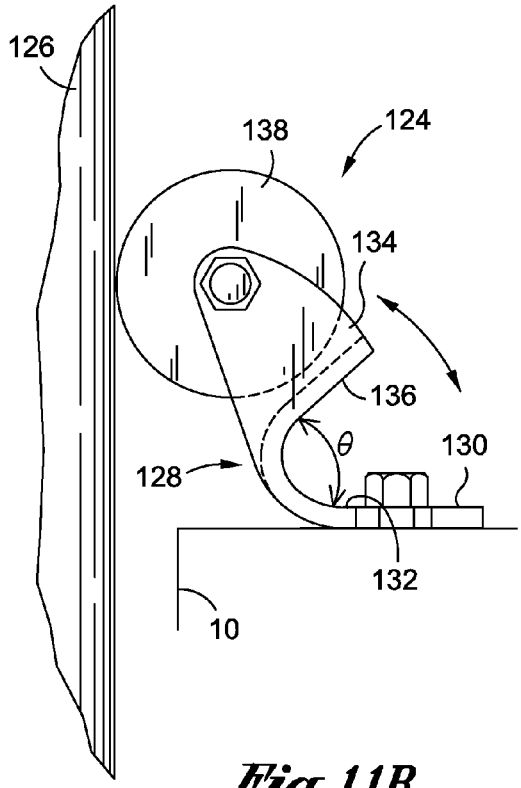
FIG. 11B is a side view of the roller illustrated in FIG. 9 in an extended position.
Figure 12:
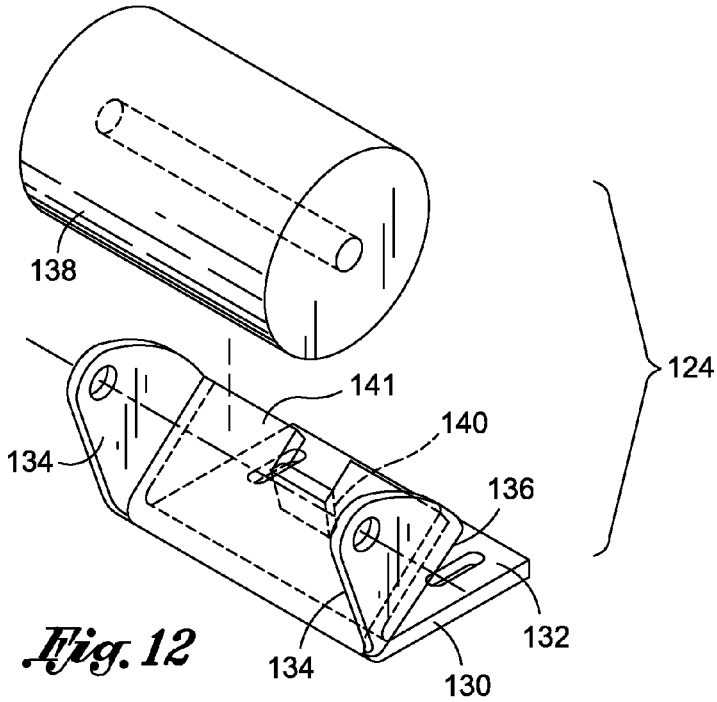
FIG. 12 is an exploded view of another embodiment of the roller, wherein the roller includes a roller bracket having a stop member to limit pivotal movement of the roller bracket.
Figure 13A:
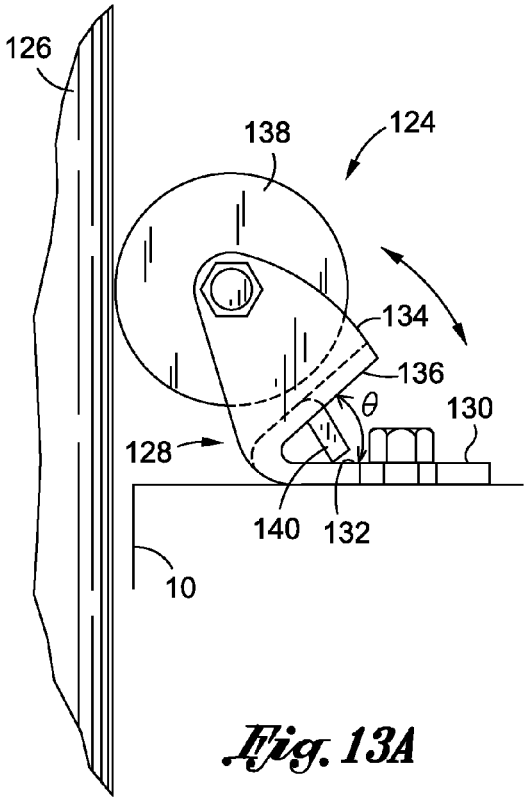
FIG. 13A is a side view of the roller illustrated in FIG. 12 in a compressed position.
Figure 13B:
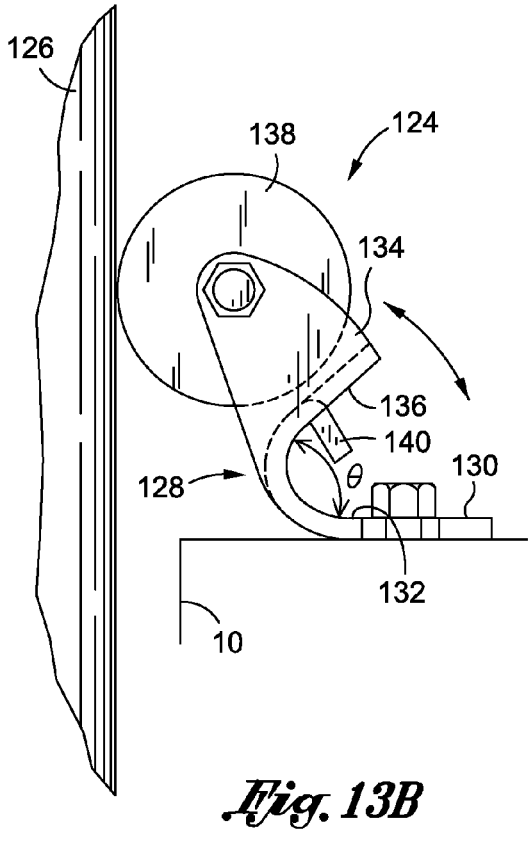
FIG. 13B is a side view of the roller illustrated in FIG. 12 in an extended position.

When the dock contact portion 130 is engaged with the dock 10, the dock contact upper surface 132 faces away from the dock 10. In this manner, the dock contact upper surface 132 may be exposed and facing upwardly, away from the water. The mechanical fastener fastening the dock contact portion 130 to the dock 10 may be disposed in contact with the dock contact upper surface 132, as shown in FIGS. 11A and 11B.

The dock contact portion 130 is connected to the bracket sidewall 134. In one embodiment, the bracket sidewall 134 is integrally formed with the dock contact portion 130, as shown in FIGS. 11A and 11B. In another embodiment, the bracket sidewall 134 is detachably connected with the dock contact portion 130. In this manner, the bracket sidewall 134 may be removed from the dock contact portion 130, which may be desirable if the bracket sidewall 134 breaks.

The bracket sidewall 134 includes a sidewall lower edge 136. As shown in FIGS. 11A and 11B, the sidewall lower edge 136 is disposed along the end portion of the bracket sidewall 134 facing the dock contact portion 130. Furthermore, in the particular embodiment illustrated in the Figures, the bracket 128 includes a bend to dispose the bracket sidewall 134 at least partially over the dock contact portion 130. In this manner, the sidewall lower edge 136 and the dock contact upper surface 132 define a bracket angle, θ.

The spring biased bracket 128 is moveable between a compressed position and an extended position. The bracket 128 may move between the compressed and extended positions to absorb impact between the dock 10 and the piling 126. The bracket angle θ increases as the spring biased bracket 128 moves from the compressed position to the extended position. The spring biased bracket 128 is biased towards the extended position. Therefore, when the dock 10 initially contacts a piling 126, the bracket 128 is likely in an extended position. As the dock 10 is urged toward the piling 126, the bracket 128 moves toward the compressed position and absorbs impact between the dock 10 and the piling 126 to provide a more stable dock 10.

Figure 10:
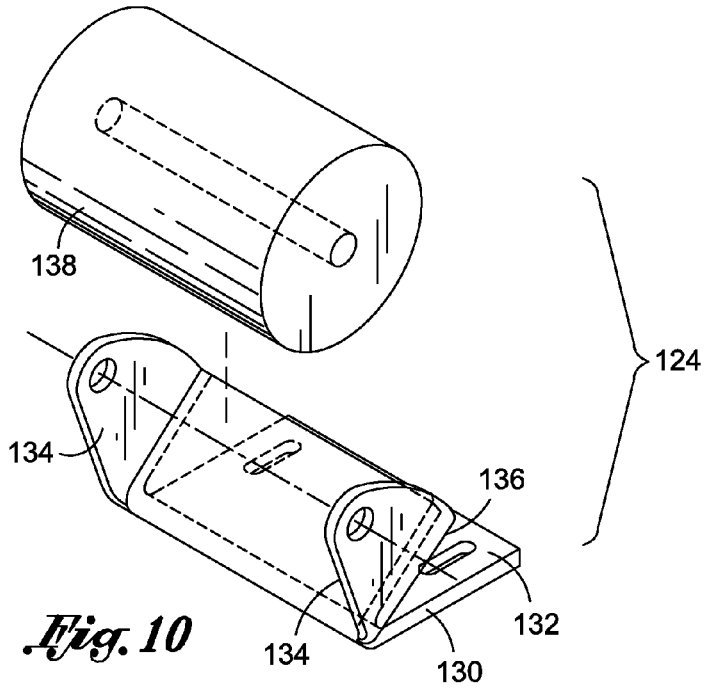
FIG. 10 is an exploded view of the roller illustrated in FIG. 9.
Figure 14A:
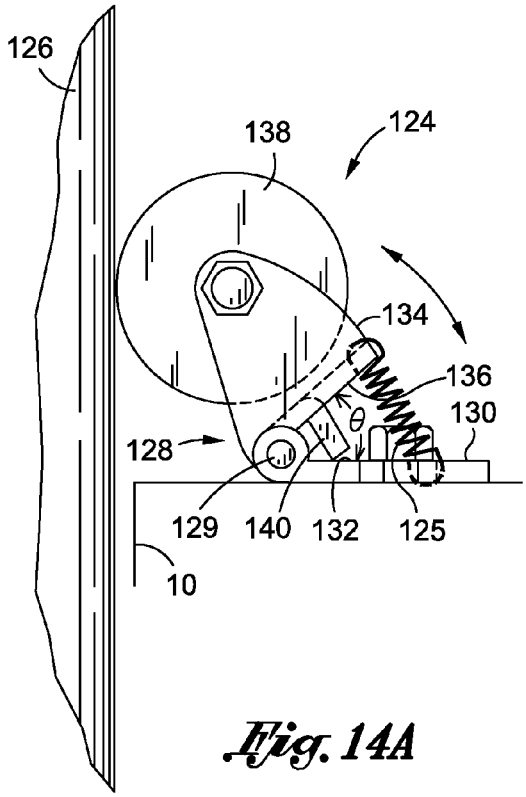
FIG. 14A is a side view of another embodiment of the roller, wherein the roller includes a coil spring connected to the bracket, the roller being in the compressed position.
Figure 14B:
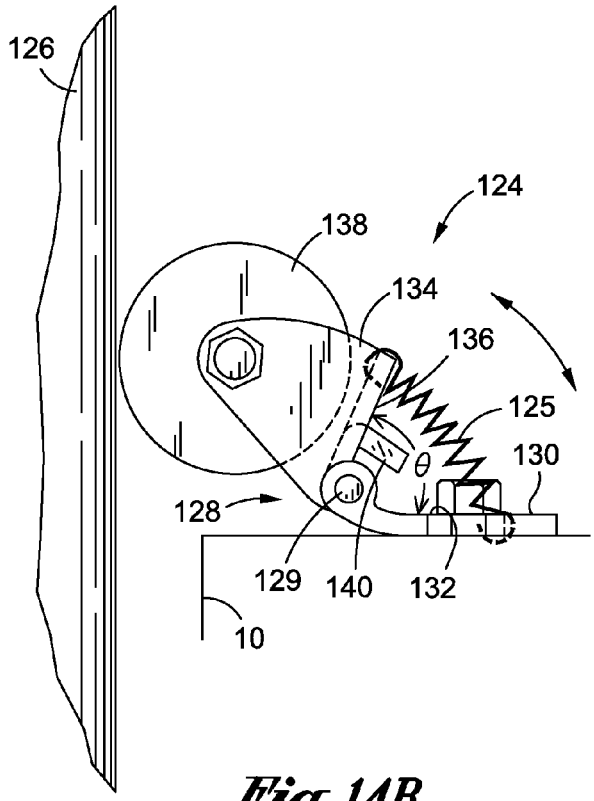
FIG. 14B is a side view of the roller shown in FIG. 14A, the roller being in the extended position.

The inherent physical properties of the bracket 128 illustrated in FIGS. 10, 11A, and 11B bias the bracket 128 toward the extended position. However, other embodiments may include additional biasing elements, such as a leaf spring, coil spring 125 (illustrated in FIGS. 14A and 14B), or other biasing mechanisms known in the art to provide additional biasing forces to the bracket 128. In embodiments where the biasing force is provided by an external element, such as a coil spring 125, the bracket 128 may include a bracket hinge 129 to enable pivotal movement of the bracket 128.

Referring now to the embodiments illustrated in FIGS. 12, 13A, 13B, 14A and 14B there is shown a bracket 128 having a stopper 140 configured to limit the amount of movement between the compressed and extended positions. As shown, the stopper 140 extends from a bracket upper wall 141 toward the dock contact upper face 132. When the bracket 128 moves from the extended position toward the compressed position, the stopper 140 is brought closer to the dock contact upper face 132. Eventually, the stopper 140 is brought into contact with the dock contact upper face 132 to mitigate further movement in that direction. Although the stopper 140 is shown extending from the bracket upper wall 141, it is also contemplated that the stopper may extend from the dock contact upper face 132 toward the bracket upper wall 141.

The roller 124 additionally includes a wheel 128 rotatably connected to the bracket sidewall 134. In the particular embodiment shown in FIG. 10, the bracket 128 includes a pair of opposing bracket sidewalls 134 disposed on opposing sides of the wheel 134. A rotation rod may extend through the wheel 128 to allow the wheel 128 to freely rotate thereabout. The rotation rod may be connected to the bracket sidewall(s) 134 by a mechanical fastener, such as a nut and bolt, or the like.

In operation, the wheel 138 is engageable with the piling 126 and rotates as the dock 10 traverses along the piling 126. The spring biased bracket 128 may move between the extended and compressed positions to enhance the stability of the dock 10. In this manner, the brackets 128 may act as shock absorbers. Furthermore, movement of the brackets 128 between the extended and compressed positions mitigates damage to the wheels 138.

Figure 1B:
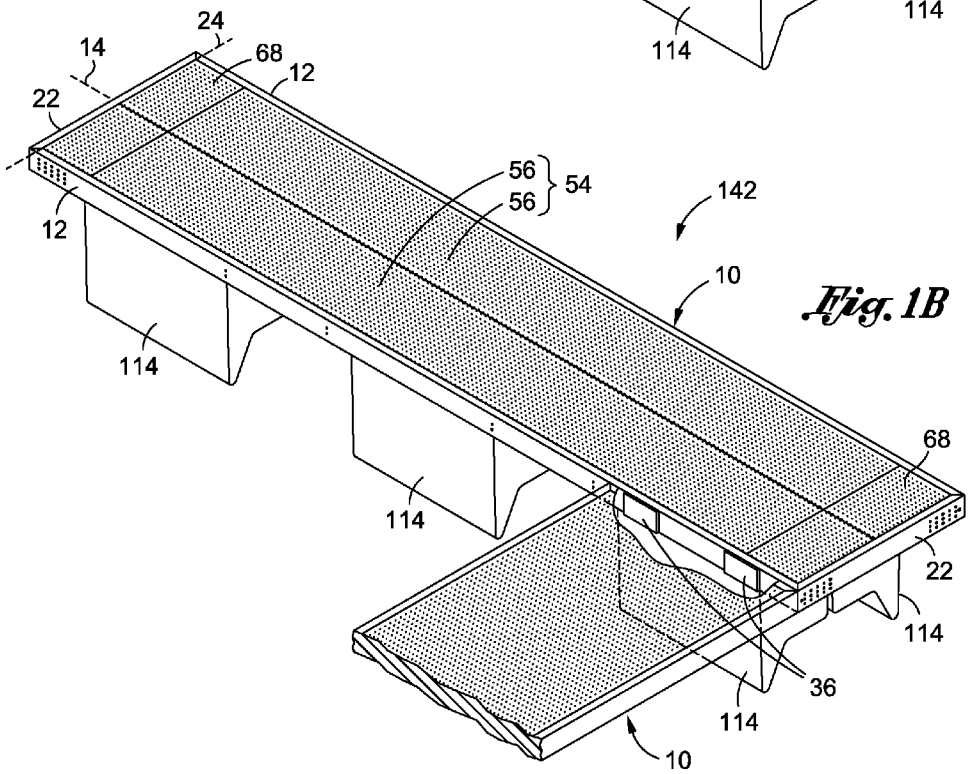
FIG. 1B is an upper perspective view of a dock assembly including two docks connected by a dock connector.
Figure 15:
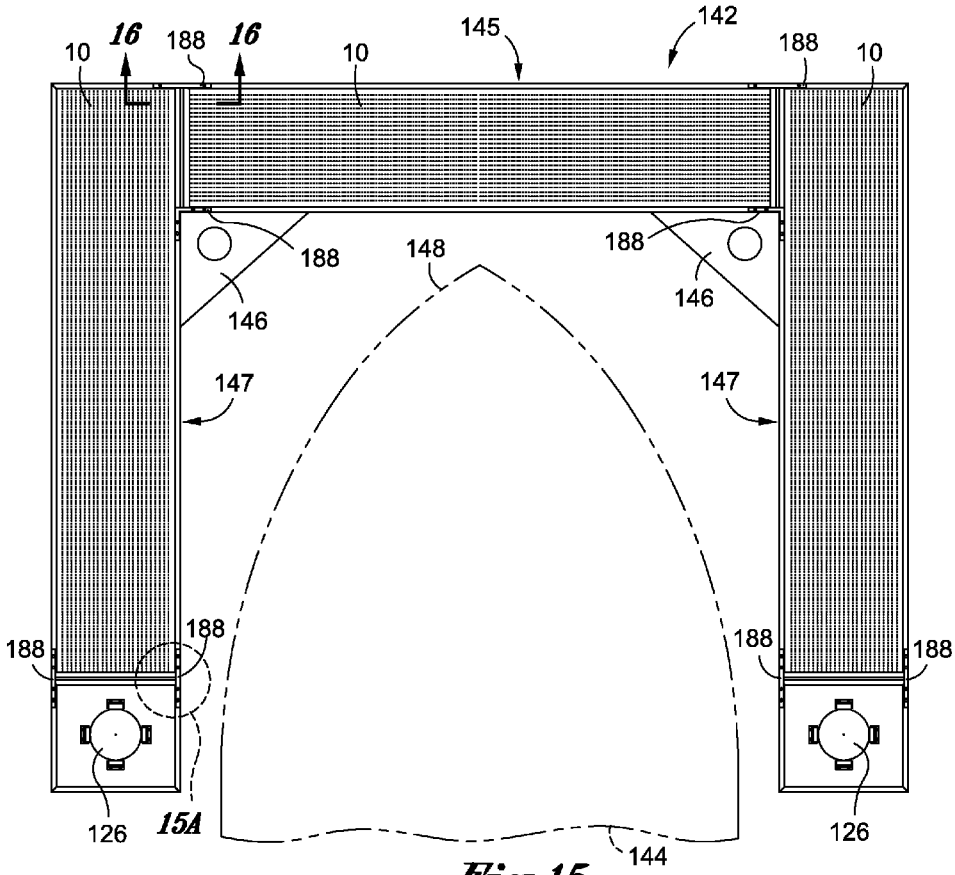
FIG. 15 is a top view of a dock assembly including three docks connected in a u-shaped configuration to form a boat slip.
Figure 16:
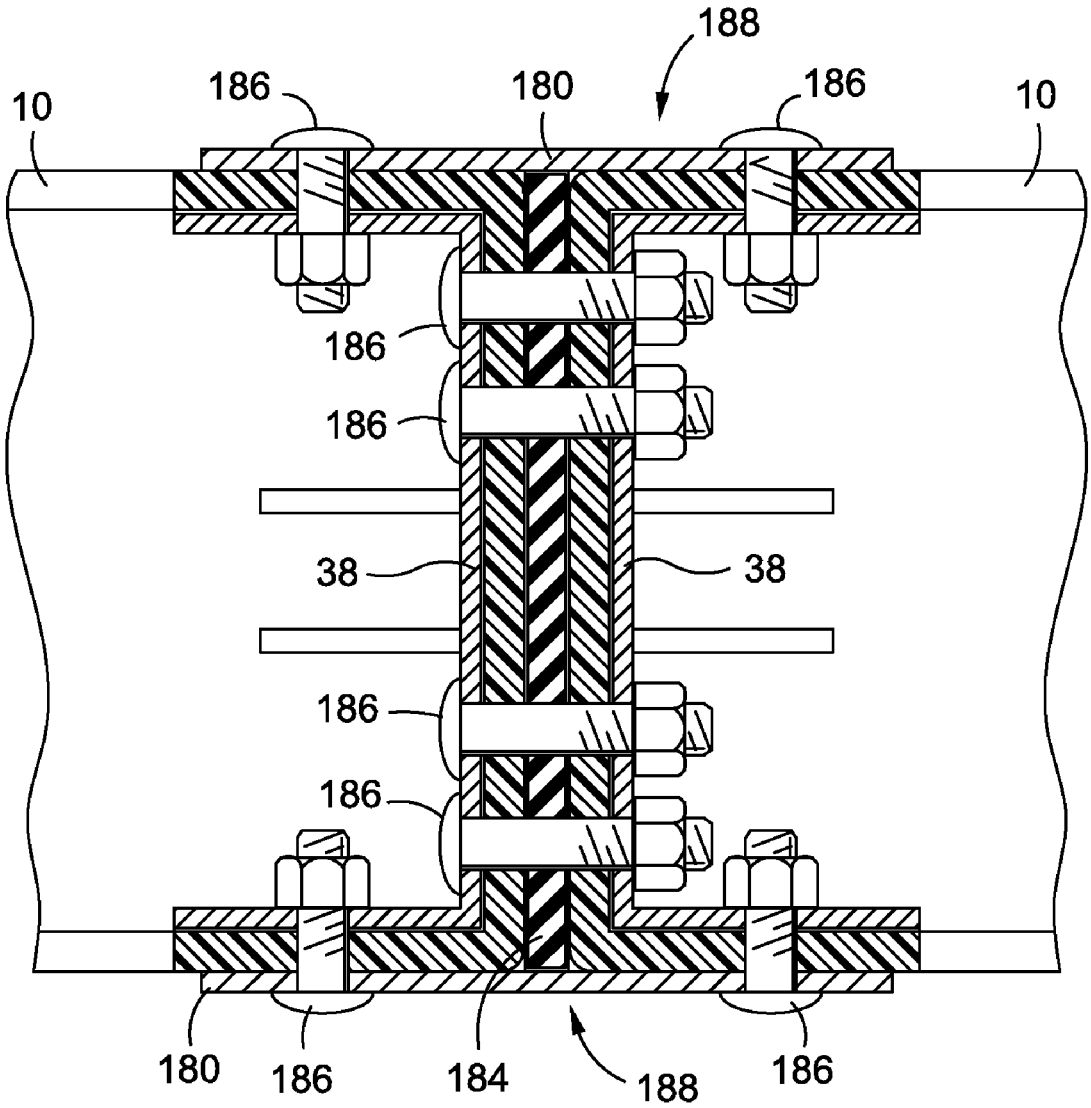
FIG. 16 is a side sectional view of adjacent docks illustrated in FIG. 15, the docks being connected by a dock connector.

Several of the above-described docks 10 may be combined to form a dock assembly 142, as depicted in FIGS. 15 and 16. The docks 10 may be easily connected in an end-to-end configuration, a side-by-side configuration or in an orthogonal configuration. A dock connector 36 may be employed to connect adjacent docks 10 in an orthogonal configuration, as shown in FIG. 1B. In particular, the dock connector 36 may be mounted on one dock 10 to facilitate orthogonal connection to an adjacent dock 10.

As shown in FIGS. 15 and 16, docks 10 are connected by a dock strap 188. The dock strap 188 attaches to the primary upper and lower flanges 16, 18, as well as the secondary upper and lower flanges 26, 28 of adjacent docks 10. The dock strap 188 includes dock connector external plate 180 that extends between the adjacent docks 10. A dock connector bolt 186 extends connects the connector external plate 180 to the dock 10. A connection gasket 184 is disposed between, and extends along the dock interface between the adjacent docks 10. The connection gasket 184 mitigates unwanted contact between adjacent docks 10. For instance, if the primary and secondary frame members 12, 22 are formed of a fiberglass material, the gasket 156 mitigates fiberglass-to-fiberglass contact. In one embodiment, the connection gasket 184 is formed of a neoprene material; however, other materials may also be used without departing from the spirit and scope of the present invention.

The dock strap 188 may be connected to the upper surfaces of the adjoining docks 10 to achieve the connection. In particular, the dock strap 188 may be connected to the primary frame members 12 and/or secondary frame members 22. A bolt 152 may connect the dock strap 188 to the respective joint support 38 connecting the primary and secondary frame members 12, 22. The dock strap 188 may be formed of a metallic, plastic, or other material known by those skilled in the art.

Figure 15A:
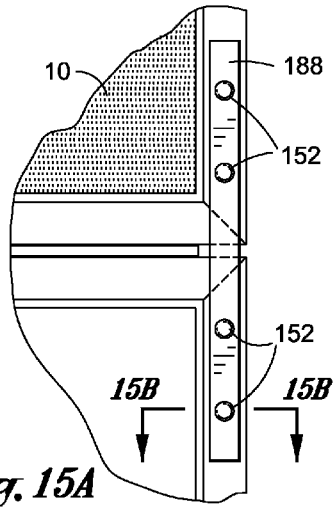
FIG. 15A is an enlarged top view of a section of adjacent dock sections connected by a dock strap.
Figure 15B:
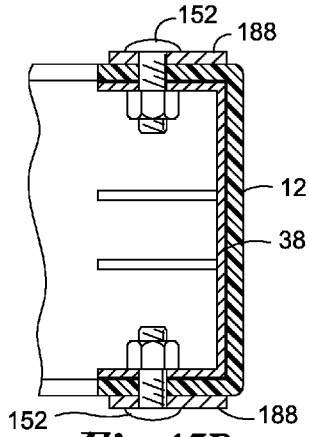
FIG. 15B is a side sectional view of the dock strap connected to the dock.

The dock strap 188 is best illustrated in FIGS. 15A and 15B. As depicted, the dock strap 188 is used to join the dock 10 with a piling platform; however, it is understood that the dock strap 188 may be used to connect adjacent docks 10. The dock strap 188 may mitigate unwanted hogging and sagging of interconnected docks 10. As used herein, sagging refers to when adjacent docks 10 are disposed in a v-shaped configuration, while hogging refers to when docks 10 are disposed in an inverse v-shaped configuration. Rough water conditions may cause adjacent docks 10 to hog or sag.

The dock assembly 142 may be configured in the shape of a slip to allow for docking of a water vessel 144, such as a motor boat or sailboat. In this manner, the dock assembly 142 may define a u-shape having an end portion 145 and two side portions 147. A corner portion 146 may be provided between adjoining docks 10 to provide structural support. In general, when the boat 144 pulls into the slip, the bow 148 of the boat 144 is disposed facing the end portion 145 of the dock assembly 142.

As previously stated, several docks 10 may be connected to form a dock assembly 142. This may be advantageous for a marina having large numbers of slips. The simple attachment and detachment of the docks 10 may allow the marina to quickly and easily reconfigure their slip configuration to accommodate different numbers and sizes of boats. For instance, sailboats tend to be narrower than motorboats. Therefore, the width of the slip for a sailboat may be much narrower than the width of the slip for a motorboat. For marinas having more sailboats than motorboats, thinner slips may be desirable. However, the slips may be easily reconfigured to accommodate wider motorboats.

Figure 17:
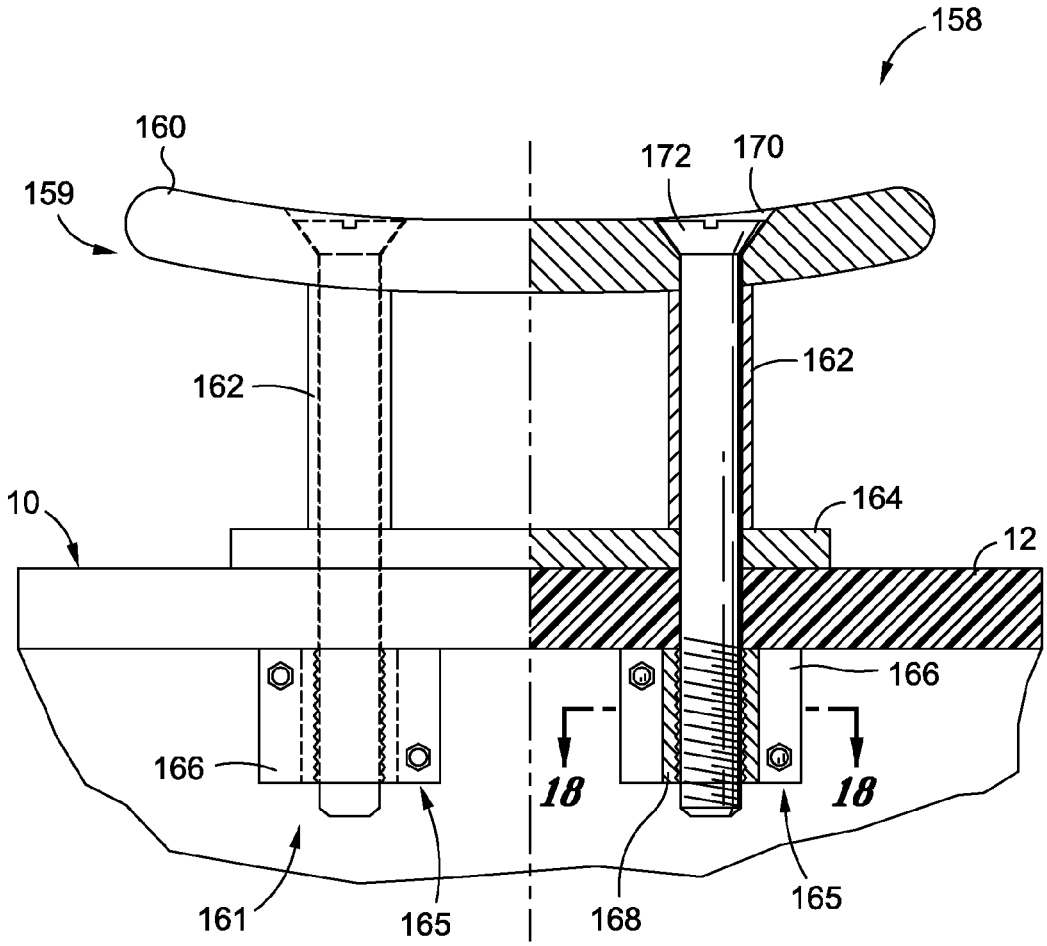
FIG. 17 is a side partial sectional view of a cleat connected to a dock.
Figure 18:
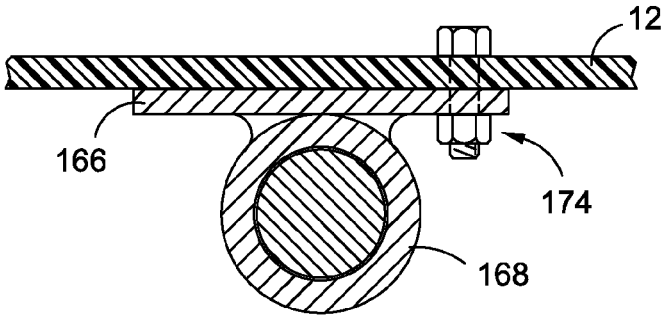
FIG. 18 is a top sectional view of a cleat bolt disposed within a connection cylinder.

Once the boat 144 is positioned within the slip, the boat 144 is typically tied or connected to the dock assembly 142. To this end, various aspects of the invention are directed toward a cleat 158 configured to provide a tie-down point for a boat 144 within a slip. Referring now to FIGS. 17 and 18, the cleat 158 is connectable to a primary or secondary frame member 12, 14 and comprises an upper cleat portion 159 and a lower cleat portion 161. The upper cleat portion 159 includes a cleat plate 164 disposable adjacent the frame member 12, 14 and a pair of cleat supports 162 extending from the cleat plate 164. A cleat bar 160 extends between and beyond the cleat supports 162, as shown in FIG. 17. In one embodiment, the cleat bar 160 is substantially straight; however, in the embodiment illustrated in FIG. 17, the cleat bar 160 defines a slight curve. The cleat bar 160 includes a pair of holes 170 aligned with the cleat supports to allow a fastener 172 to be disposed therein, as described in more detail below.

The cleat lower portion 161 includes a pair of cleat connection members 165 mounted to the frame member 12, 14. The connection members 165 include a connection plate 166 and an internally threaded connection cylinder 168. The connection plate 166 is fastened to a frame member 12, 14 by a mechanical fastener; however, adhesives or other known fasteners may also be used.

In order to fasten the cleat 158 to the frame member 12, 14, the upper cleat portion 159 is connected to the lower cleat portion 161 via a threaded fastener 172. The threaded fastener 172 is inserted through the cleat supports 162 and the connection cylinders 168. In this manner, the individual cleat supports 162 are aligned with respective connection cylinders 168. The fastener 172 is screwed into engagement with the internally threaded connection cylinders 168 to securely fasten the upper cleat portion 159 to the lower cleat portion 161. The holes 170 in the cleat bar 160 may be countersunk to allow the head portion of the fastener 172 to be disposed under the outer surface of the cleat bar 160. As such, the head portion may not be exposed beyond the outer surface of the cleat bar 160.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A dock comprising:

a pair of primary frame members formed of a fiber-reinforced resin material, each primary frame member defining a primary lower edge and a primary upper edge, the pair of primary frame members extending parallel to a primary axis and arranged in opposed, spaced parallel relation to each other;

a pair of secondary frame members formed of a fiber-reinforced resin material, each secondary frame member defining a secondary lower edge and a secondary upper edge, the pair of secondary frame members extending parallel to a secondary axis and arranged in opposed, spaced parallel relation to each other, each secondary frame member being connected to the pair of primary frame members;

a plurality of cross members, each cross member connected to and extending between the pair of primary frame members, each cross member including an upper platform contact face disposed within a common upper platform contact plane;

a plurality of joint supports, each joint support having a primary joint face connected to one of the pair of primary frame members and a secondary joint face connected to one of the pair of secondary frame members, the primary joint face substantially extending from the primary lower edge to the primary upper edge of the respective one of the pair of primary frame members, the secondary joint face substantially extending from the secondary lower edge to the secondary upper edge of the respective one of the pair of secondary frame members, each joint support including a plurality of flow channels extending through the primary joint face and the secondary joint face; and an adhesive disposed between each joint support and the respective primary and secondary frame members, the adhesive being disposed within at least one of the plurality of flow channels for connecting each joint support to the respective primary and secondary frame members.

2. The dock as recited in claim 1 further including an upper platform formed of a fiber-reinforced resin material, the upper platform having an upper walking portion and a lower contact surface disposed in contact with each upper platform contact face.

3. The dock as recited in claim 2 wherein the upper platform is connected to each upper platform contact face via a mechanical fastener.

4. The dock as recited in claim 3 wherein the mechanical fastener is double backed adhesive tape.

5. The dock as recited in claim 3 wherein the mechanical fastener is an adhesive.

6. The dock as recited in claim 2 wherein the upper platform includes a plurality of interconnected upper platform elements.

7. The dock as recited in claim 1 further including a plurality of cross member connectors, each cross member connector having a cross member contact face connected to a respective one of the plurality of cross members and a primary contact face connected to a respective one of the pair of primary frame members.

8. The dock as recited in claim 1 wherein the secondary axis is orthogonal to the primary axis.

9. The dock as recited in claim 1 further including a floatation shell having opposing shell lateral portions, the floatation shell defining a floatation cavity, the floatation shell being attached a respective one of the plurality of cross members, the floatation shell including:

a shell base; and a pair of opposing floatation fins extending away from the shell base to define respective fin distal portions, each floatation fin disposed adjacent a respective one of the opposing shell lateral portions, each fin having a fin medial face and a fin lateral face defining a fin width therebetween, the fin width decreasing from the shell base towards the fin distal portion.

10. The dock as recited in claim 1 wherein the primary and secondary frame members are formed of a pultruded material.

11. A dock comprising:

a pair of primary frame members formed of a fiber-reinforced resin material, the pair of primary frame members extending parallel to a primary axis and arranged in opposed, spaced parallel relation to each other;

a pair of secondary frame members formed of a fiber-reinforced resin material, the pair of secondary frame members extending parallel to a secondary axis and arranged in opposed, spaced parallel relation to each other, each secondary frame member being connected to the pair of primary frame members;

a plurality of cross members, each cross member connected to and extending between the pair of primary frame members, each cross member including an upper platform contact face disposed within a common upper platform contact plane; and a plurality of joint supports, each joint support having a primary joint face connected to one of the pair of primary frame members and a secondary joint face connected to one of the pair of secondary frame members, wherein each joint support includes a joint platform contact face disposed within the common upper platform contact plane.

12. A float system for use with a dock at least partially extending over a body of water, the dock having an upper walking portion facing away from the water and an opposing lower water-facing portion, the float system comprising:

a floatation shell having opposing shell lateral portions, the floatation shell defining a floatation cavity, the floatation shell being disposable beneath the lower water-facing surface of the dock, the floatation shell including:

a shell base; and a pair of opposing floatation fins extending away from the shell base to define respective fin distal portions, each floatation fin disposed adjacent a respective one of the opposing shell lateral portions, each floatation fin having a fin medial face and a fin lateral face defining a fin width therebetween, the fin width decreasing from the shell base towards the fin distal portion;

wherein the floatation shell includes a pair of floatation elements collectively defining the floatation shell, each floatation element including a respective one of the pair of opposing floatation fins.

13. The float system as recited in claim 12 further comprising a buoyant element disposed within the floatation cavity for increasing the buoyancy of the floatation shell.

14. The float system as recited in claim 12 further comprising an attachment flange connected to the floatation shell, the attachment flange having a plurality of fastener openings for attachment to the dock.

15. A float system for use with a dock at least partially extending over a body of water, the dock having an upper walking portion facing away from the water and an opposing lower water-facing portion, the float system comprising:

a floatation shell having opposing shell lateral portions, the floatation shell defining a floatation cavity, the floatation shell being disposable beneath the lower water-facing surface of the dock, the floatation shell including:

a shell base;

a pair of opposing floatation fins extending away from the shell base to define respective fin distal portions, each floatation fin disposed adjacent a respective one of the opposing shell lateral portions, each floatation fin having a fin medial face and a fin lateral face defining a fin width therebetween, the fin width decreasing from the shell base towards the fin distal portion; and a plurality of press-fit engagement members extending outwardly from the shell base, the plurality of press-fit engagement members configured for press-fit engagement with the dock.

16. A roller for a use on a dock positioned near a piling, the roller including:

a spring biased bracket having:

a dock contact portion being engageable with the dock, the dock contact portion having a dock contact upper surface; and a bracket sidewall having a sidewall lower edge, the sidewall lower edge and the dock contact upper surface defining a bracket angle, the spring biased bracket being moveable between a compressed position and an extended position, the bracket angle increasing as the spring biased bracket moves from the compressed position to the extended position, the spring biased bracket being biased towards the extended position; and a wheel rotatably connected to the bracket sidewall, the wheel being engageable with the piling.

17. The roller as recited in claim 16 wherein the bracket sidewall is integrally formed with the dock contact portion.

* * * * *